US012193621B2

(12) United States Patent
De Wit et al.

(10) Patent No.: US 12,193,621 B2
(45) Date of Patent: Jan. 14, 2025

(54) DETERMINING A START-UP OPERATION MODE OF A WETTING SYSTEM OF A CLEANING DEVICE

(71) Applicant: KONINKLIJKE PHILIPS N.V, Eindhoven (NL)

(72) Inventors: Bastiaan Johannes De Wit, Eindhoven (NL); Anke Rieka Meulendijks, Eindhoven (NL); Jamila Midhat, Eindhoven (NL); Orhan Kahya, Eindhoven (NL); Chengang Cao, Eindhoven (NL); Rinse Hendrik Bosma, Eindhoven (NL); Fermin Espin Franco, Eindhoven (NL); Robert Friso Burgers, Eindhoven (NL); Albert Al-Shorachi, Eindhoven (NL); Arjan Sander Vonk, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 286 days.

(21) Appl. No.: 17/788,700

(22) PCT Filed: Dec. 23, 2020

(86) PCT No.: PCT/EP2020/087807
§ 371 (c)(1),
(2) Date: Jun. 23, 2022

(87) PCT Pub. No.: WO2021/130332
PCT Pub. Date: Jul. 1, 2021

(65) Prior Publication Data

US 2023/0023753 A1 Jan. 26, 2023

(30) Foreign Application Priority Data

Dec. 23, 2019 (EP) ..... 19219334

(51) Int. Cl.
*A47L 11/40* (2006.01)

(52) U.S. Cl.
CPC ..... *A47L 11/4011* (2013.01); *A47L 11/4005* (2013.01); *A47L 11/4016* (2013.01);
(Continued)

(58) Field of Classification Search
CPC ..... A47L 11/4011; A47L 11/4041; A47L 11/4083
See application file for complete search history.

(56) References Cited

U.S. PATENT DOCUMENTS

2003/0159232 A1 8/2003 Hekman et al.
2005/0236012 A1 10/2005 Josefsson et al.
(Continued)

FOREIGN PATENT DOCUMENTS

CN 1550198 A 12/2004
CN 1767781 A 5/2006
(Continued)

*Primary Examiner* — Andrew A Horton
(74) *Attorney, Agent, or Firm* — Maschoff Brennan

(57) ABSTRACT

A cleaning device for cleaning a surface is described. The cleaning device includes at least one cleaning element and a wetting system to supply a cleaning liquid to the at least one cleaning element. The wetting system is operable in one of at least one normal operation mode and a boost operation mode involving an increased supply rate of the cleaning liquid with respect to the at least one normal operation mode. During start-up of the cleaning device in a wet cleaning mode thereof, a start-up operation mode of the wetting system is determined to be one of the normal operation mode or the boost operation mode on the basis of assessment of an actual value of at least one parameter that is indicative of whether or not the at least one cleaning element is in a wet cleaning condition.

15 Claims, 1 Drawing Sheet

(52) U.S. Cl.
CPC ..... *A47L 11/4041* (2013.01); *A47L 11/4083* (2013.01); *A47L 11/4088* (2013.01); *A47L 11/4091* (2013.01)

(56) References Cited

U.S. PATENT DOCUMENTS

| | | | | |
|---|---|---|---|---|
| 2018/0110388 | A1* | 4/2018 | Xia | A47L 11/4044 |
| 2018/0228332 | A1 | 8/2018 | Goff | |
| 2019/0133398 | A1 | 5/2019 | Chavana, Jr. | |

FOREIGN PATENT DOCUMENTS

| | | | |
|---|---|---|---|
| CN | 101426591 | A | 5/2009 |
| CN | 204207679 | U | 3/2015 |
| CN | 106793911 | A | 5/2017 |
| CN | 106998975 | A | 8/2017 |
| CN | 108968835 | A | 12/2018 |
| CN | 109310252 | A | 2/2019 |
| CN | 109864668 | A | 6/2019 |
| CN | 110338720 | A | 10/2019 |
| WO | 2010/041184 | A1 | 4/2010 |
| WO | 2019/166763 | A1 | 9/2019 |

* cited by examiner

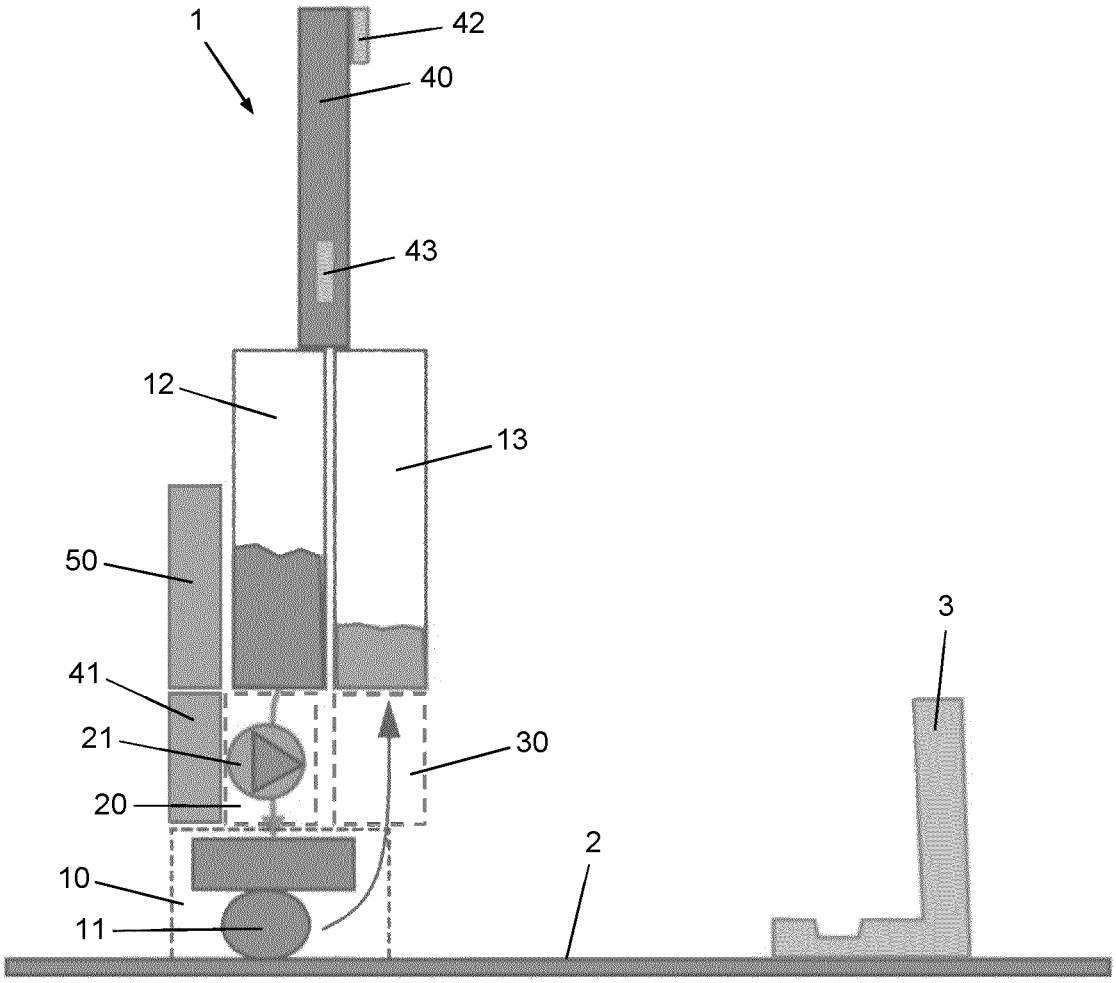
1
42
40
43
12
13
50
41
21
20
30
10
11
2
3

DETERMINING A START-UP OPERATION MODE OF A WETTING SYSTEM OF A CLEANING DEVICE

CROSS-REFERENCE TO RELATED APPLICATIONS

The present application is a U.S. National Phase application under 35 U.S.C. § 371 of International Application No. PCT/EP2020/087807 filed Dec. 23, 2020, which claims the benefit of European Patent Application No. 19219334.0, filed on Dec. 23, 2019. These applications are hereby incorporated by reference herein.

FIELD OF THE INVENTION

The invention relates to a cleaning device for cleaning a surface, the cleaning device being operable in at least a wet operation mode and comprising i) at least one cleaning element configured to perform a cleaning action on the surface to be cleaned, ii) a wetting system configured to supply a cleaning liquid to an area where the at least one cleaning element is located to thereby realize a wet cleaning condition of the at least one cleaning element in the wet operation mode of the cleaning device, and iii) a controlling system configured to control operation of the cleaning device according to an operation program, wherein the operation program includes a wet operation mode algorithm.

Further, the invention relates to a set of a cleaning device as defined in the foregoing and a charging dock, wherein the cleaning device comprises a rechargeable battery arrangement, and wherein the charging dock is configured to receive and hold the cleaning device and to charge the battery arrangement of the cleaning device when the cleaning device is in place on the charging dock.

BACKGROUND OF THE INVENTION

WO 2010/041184 A1 relates to a cleaning device for cleaning a surface, which comprises at least one brush that is rotatable in a rotation direction and movable over a surface to be cleaned, whereby the at least one brush is effective in loosening and removing dirt from the surface to be cleaned during operation of the cleaning device. The cleaning device is suitable for cleaning with or without a cleaning liquid. In view of the first option, the cleaning device comprises a wetting system for supplying the cleaning liquid to the at least one brush. In case a user of the cleaning device desires to perform a wet cleaning action by means of the cleaning device, the wetting system is activated to supply the cleaning liquid to the at least one brush. As a result, the surface to be cleaned is wetted by means of the at least one brush, and the at least one brush also acts to remove the cleaning liquid from the surface to be cleaned, together with the dirt.

It appears in practice that when the user has taken action to initiate a wet cleaning action, it may take quite some time before such a wet cleaning action is actually performed in a proper manner. This is especially the case when the at least one brush is dry, as in such a situation, not only does it take time to establish a flow of the cleaning liquid towards the at least one brush, but it also takes time to get the at least one brush wet to a sufficient extent. During a start-up time after an initiation of a wet cleaning action, the user observes a rather slow start-up action of the cleaning device, wherein first some wet stripes appear on the surface to be cleaned before the wet cleaning action is performed in an optimal manner. This may deviate from expectations held by at least some users, and moreover, this renders the cleaning device unsuitable for "grab-and-go" use for spot cleaning.

US 20,191,33398A1 discloses an apparatus that includes a body, a first tank and a second tank. The body includes a front side, a back side, a top side and a bottom side. The body also includes a first fluid output, a first air passage, a second air passage, and a third air passage. A nozzle is removably attached to the front side of the body. The nozzle includes a fourth air passage proximate the bottom side of the body and a fifth air passage proximate the top side of the body. The fifth air passage is communicatively coupled with the fourth air passage. The nozzle is attached to the body such that the first air passage and the fifth air passage are substantially aligned. The apparatus also includes a handle coupled with the body, a vacuum motor, a fluid pump and a controller configured to activate the fluid pump and/or the vacuum motor.

SUMMARY OF THE INVENTION

It is an object of the invention to provide a cleaning device that is adapted to perform a start-up procedure of a wet cleaning action in a shorter time than cleaning devices known in the art, so that a user can actually have a "grab-and-go" experience when using the cleaning device, irrespective of whether the cleaning device is operated to perform a dry cleaning action or a wet cleaning action, whereby user satisfaction can be improved.

The invention provides a cleaning device for cleaning a surface, the cleaning device being operable in at least a wet operation mode and comprising i) at least one cleaning element configured to perform a cleaning action on the surface to be cleaned, ii) a wetting system configured to supply a cleaning liquid to an area where the at least one cleaning element is located to thereby realize a wet cleaning condition of the at least one cleaning element in the wet operation mode of the cleaning device, wherein the wetting system is operable in one of at least one normal operation mode and a boost operation mode involving an increased supply rate of the cleaning liquid with respect to the at least one normal operation mode, and iii) a controlling system configured to control operation of the cleaning device according to an operation program, wherein the operation program includes a wet operation mode algorithm involving a sequence of start-up steps to be taken when the wet operation mode of the cleaning device is initiated, and wherein the start-up steps comprise retrieving an actual value of at least one parameter that is indicative of whether or not the at least one cleaning element is in the wet cleaning condition, determining a start-up operation mode of the wetting system to be one of the at least one normal operation mode or the boost operation mode by relating the actual value of the at least one parameter to an operation mode of the wetting system according to a predetermined relation between values of the at least one parameter and the respective operation modes of the wetting system, and controlling the wetting system to operate in the start-up operation mode.

It follows from the foregoing definition that the cleaning device according to the invention is configured to clean a surface and comprises at least one cleaning element, a wetting system and a controlling system for accomplishing the intended surface cleaning effect. The invention is applicable in the context of cleaning any type of surface, including soft floor surfaces such as floor surfaces with carpets and hard floor surfaces such as floor surfaces with tiles.

The at least one cleaning element of the cleaning device according to the invention is configured to actually interact with the surface to be cleaned and may comprise a brush, for example. The at least one cleaning element may as well be of another design and include a cleaning pad, a cleaning mop and a cloth including micro fiber brush elements. In a practical embodiment of a brush, the brush may be shaped more or less like roller having a substantially circular cross-section, in which case the brush may be arranged in the cleaning device so as to be rotatable about the longitudinal axis of the brush. In general, the at least one cleaning element may be movable in the cleaning device. In the case of the at least one cleaning element comprising a brush, the brush may be designed so as to include flexible brush elements having tip portions for contacting the surface to be cleaned.

The wetting system of the cleaning device according to the invention is configured to wet the at least one cleaning element in case it is desired to operate the cleaning device in the wet operation mode. The wetting system is particularly configured to supply a cleaning liquid such as water or a water/soap mixture to an area where the at least one cleaning element is located, and may be designed to realize a wet cleaning condition of the at least one cleaning element in a direct manner and/or an indirect manner, i.e. by spraying/dripping liquid directly on the at least one cleaning element and/or providing liquid to the core of the at least one cleaning element, for example, and/or by spraying/dripping liquid on an area of the surface to be cleaned that is covered by the at least one cleaning element so that the at least one cleaning element is wetted under the influence of contact to that area of the surface to be cleaned. According to the invention, the wetting system is operable in one of at least one normal operation mode and a boost operation mode involving an increased supply rate of the cleaning liquid with respect to the at least one normal operation mode. By having the option of setting the boost operation mode of the wetting system, it is possible to realize a fast start-up procedure of a wet cleaning action under all circumstances, irrespective of whether or not the at least one cleaning element is in the wet cleaning condition. Basically, this may be done by simply including a step of setting the boost operation mode of the wetting system during a predetermined period of time in the start-up procedure of a wet cleaning action as a default, but it is preferred to take measures aimed at ensuring that the boost operation mode of the wetting system is only set when it is deemed useful to do so, as will be explained in the following.

The fact that the boost operation mode involves an increased supply rate of the cleaning liquid with respect to the at least one normal operation mode does not necessary imply that the boost operation mode involves a single relatively high value of the supply rate of the cleaning liquid. Instead, it is possible that the boost operation mode involves more values of the supply rate of the cleaning fluid, wherein a number of discrete values may be set in a stepped manner as time passes, or wherein the supply rate of the cleaning fluid may be varied in a more or less continuous manner.

In a practical embodiment, the wetting system includes a pump arrangement configured to supply the cleaning liquid to the area where the at least one cleaning element is located by pumping the cleaning liquid towards the area where the at least one cleaning element is located. In such a case, there is no need for the cleaning device to be provided with additional components for realizing the boost operation mode of the wetting system, as the boost operation mode may simply involve operating the pump arrangement to run at a higher pumping speed than in the at least one normal operation mode of the wetting system. Variations in pumping speed when switching from one operation mode to another may take place in a stepwise fashion or in a gradual fashion. Alternatively or additionally to operating the pump arrangement to run at a higher pumping speed, the pump arrangement may be operated to address another supply line of the cleaning liquid, particularly a supply line designed to allow larger volumes of cleaning liquid to pass.

The controlling system of the cleaning device according to the invention is configured to control operation of the cleaning device according to an operation program, and may comprise a microcontroller or the like having a memory in which the operation program is stored. The cleaning device may be equipped with a user interface for allowing a user of the cleaning device to influence the way in which the cleaning system is operated by addressing one or more particular algorithms of the operation program and/or temporarily overruling the operation program.

The operation program includes a wet operation mode algorithm, i.e. an algorithm to be followed when the cleaning device is to be operated in the wet operation mode. According to the invention, the wet operation mode algorithm involves a sequence of start-up steps to be taken when the wet operation mode of the cleaning device is initiated. In this respect, it is noted that it is possible to have an embodiment of the cleaning device in which the wet operation mode of the cleaning device is automatically initiated as a default when the cleaning device is put from an off mode to an on mode. As an alternative, it is possible to have an embodiment of the cleaning device in which the wet operation mode of the cleaning device is initiated only upon receipt of a user's command to that end. The alternative is especially applicable when the cleaning device is also operable in a dry operation mode, i.e. an operation mode in which there is no need for using the cleaning liquid so that the wetting system should be kept inactivated.

The start-up steps of the wet operation algorithm comprise retrieving an actual value of at least one parameter that is indicative of whether or not the at least one cleaning element is in the wet cleaning condition. In a practical sense, a sensor arrangement could be used to measure wetness of the at least one cleaning element directly or indirectly. Various examples of the at least one parameter as mentioned are feasible within the scope of the invention. For example, the at least one parameter may be the duration of a period of inactivity of the cleaning device, based on the fact that the longer the period of inactivity, the higher the chance that the at least one cleaning element is not in the wet cleaning condition. In such a case, the cleaning device may be equipped with a timer to be activated to count when a predetermined event takes place in respect of the cleaning device, wherein retrieving an actual value of at least one parameter that is indicative of whether or not the at least one cleaning element is in the wet cleaning condition may comprise retrieving an actual time value from the timer. A first example of the predetermined event is termination of operation of the wetting system. A second example of the predetermined event relates to the option of the cleaning device comprising a battery arrangement, and is full depletion of the battery arrangement or replacement of the battery arrangement. It is noted that it may be useful to have a small capacitor or the like for keeping the timer going even when the battery arrangement has run out or removed. The timer may be included in a remote device such as a computer or may be present in the cloud (internet). In any case, the actual time value that may be retrieved from the timer may be used in a process such as making a comparison to time values in a look-up table in order to assess whether or not the at least one cleaning element may be expected to be in the wet cleaning condition. The invention covers all possible options when it comes to activating the timer to count, including an option of activating the timer to count up from zero, an option of activating the timer to count up from a value higher than zero, and an option of activating the timer to count down from a value higher than zero.

In general, it is noted that time-related data may be used for determining whether or not it may be applicable to operate the cleaning device in the boost operation mode. The time-related data may be stored at any suitable place and may be retrieved in any suitable way. For example, it is possible to send time-related data to the cloud for every start and stop of the wetting system. In that case, a time difference may be determined at any given moment, and the time difference may be compared to a threshold in order to determine the appropriate start-up operation mode.

In case the cleaning device comprises a rechargeable battery arrangement, the at least one parameter that is indicative of whether or not the at least one cleaning element is in the wet cleaning condition may be a yes or no indication of whether the rechargeable battery arrangement has recently been charged. In other words, in such a case, retrieving an actual value of at least one parameter that is indicative of whether or not the at least one cleaning element is in the wet cleaning condition may comprise retrieving an indication of whether or not a charging process of the rechargeable battery arrangement has taken place prior to an initiation of the wet operation mode of the cleaning device. If a yes indication is retrieved, this may be taken as an indication of a dry condition of the at least one cleaning element based on the assumption that the cleaning device has been on a charging dock or the like for quite some time. Further, based on the assumption that the at least one cleaning element is replaceable and that a newly installed cleaning element is in a dry condition, it may be practical if retrieving an actual value of at least one parameter that is indicative of whether or not the at least one cleaning element is in the wet cleaning condition comprises retrieving an indication of whether or not an action of putting the at least one cleaning element to place in the cleaning device has taken place prior to an initiation of the wet operation mode of the cleaning device.

Further start-up steps include determining a start-up operation mode of the wetting system to be one of the at least one normal operation mode or the boost operation mode by relating the actual value of the at least one parameter to an operation mode of the wetting system according to a predetermined relation between values of the at least one parameter and the respective operation modes of the wetting system, and controlling the wetting system to operate in the start-up operation mode. On the basis of these steps, the boost operation mode of the wetting system is triggered automatically when it appears to be applicable to set this particular operation mode. In respect of the process of relating the actual value of the at least one parameter to an operation mode of the wetting system according to a predetermined relation between values of the at least one parameter and the respective operation modes of the wetting system, it is noted that this may be done in any suitable way. Assuming that only two possibilities of the values of the at least one parameter exist, which is the case if the at least one parameter is some kind of yes or no indication, the one operation mode may be directly associated with the one possible value of the at least one parameter, and the other operation mode may be directly associated with the other possible value of the at least one parameter. Assuming that more values of the at least one parameter are possible and that the values can be expressed numerically, the mode of operation that is associated with an actual value of the at least one parameter may be found by determining whether the value is higher or lower than a threshold value, or by using a look-up table or the like, for example.

Relying on an actual value of at least one parameter that is indicative of whether or not the at least one cleaning element is in the wet cleaning condition in a process of determining whether or not the wetting system is to be operated in the boost operation mode involves in fact an estimation of actual practical aspects. On the basis of one or more given values, choices are made in conformity with what may be expected to be an actual situation. According to the invention, it is not necessary to actually detect an extent to which the at least one cleaning element is wet, so that complex use of components such as a moisture detector in relation to the at least one cleaning element may be avoided. Nevertheless, detection of wetness may be implemented for the purpose of determining whether the boost operation mode is to be triggered, but at another position in the cleaning device than in relation to the at least one cleaning element, such as at the position of an exhaust filter as may be arranged in air communication with the at least one cleaning element, for example. It is advantageous if the at least one parameter is chosen such that a situation of not operating the wetting system in the boost operation mode when the at least one cleaning element is too dry is avoided, while it is not a problem if a situation of operating the wetting system in the boost operation mode when this is actually not necessary occurs from time to time. The invention may involve a practical combination of avoiding a slow start-up procedure of a wet cleaning action and not unnecessarily triggering the boost operation mode of the wetting system.

It may further be practical if the cleaning device is adapted to enable the boost operation mode of the wetting system to be triggered manually. To that end, the cleaning device may be equipped with a user interface as mentioned earlier, in which case it is advantageous if the user interface is configured to at least communicate a user's command to operate the wetting system in the boost operation mode to the controlling system, and if the controlling system is configured to control the wetting system to operate in the boost operation mode during a predetermined period of time upon receipt of such a command from the user interface.

In general, as the boost operation mode of the wetting system is only needed to quickly ensure a wet cleaning condition of the at least one cleaning element, there is no need to operate the wetting system in the boost operation mode longer than a predetermined period of time. Hence, it is practical if the start-up steps comprise controlling the wetting system to stop operating in the start-up operation mode after a predetermined period of time in case the start-up operation mode of the wetting system is the boost operation mode, so that also when the boost operation mode of the wetting system is triggered automatically, that particular operation mode of the wetting system is maintained during a limited period of time only.

As mentioned earlier, it is also possible that the cleaning device is operable in a dry operation mode, in which case a user may be provided with a choice to realize a wet cleaning action or a dry cleaning action by means of the cleaning device. In particular, assuming that the cleaning device is equipped with a user interface, the user interface may be configured to also communicate a user's command to operate the cleaning system in the dry operation mode to the controlling system, wherein it is practical if the operation program includes a dry operation mode algorithm according to which the wetting system is inactivated.

In respect of the use of the cleaning liquid in the cleaning device according to the invention, it is noted that it may be practical if the cleaning device comprises a reservoir configured to contain the cleaning liquid to be supplied to the area where the at least one cleaning element is located by means of the wetting system and/or if the cleaning device comprises a discharging system configured to receive a liquid/dirt mixture from the at least one cleaning element and to discharge the liquid/dirt mixture to a collection area. Further, in order to enhance a process of picking up dirt from the surface to be cleaned, it may be practical if the cleaning device comprises a vacuum system including a vacuum source configured to generate underpressure at the position of the at least one cleaning element, in which case the cleaning device may also be referred to as vacuum cleaner.

The above-described and other aspects of the invention will be apparent from and elucidated with reference to the following detailed description of an embodiment of a wet cleaning device.

BRIEF DESCRIPTION OF THE DRAWINGS

The invention will now be explained in greater detail with reference to FIG. 1, which is a diagrammatic representation of a wet cleaning device according to an embodiment of the invention, a surface to be cleaned, and a charging dock.

DETAILED DESCRIPTION OF EMBODIMENTS

FIG. 1 illustrates the design of a wet cleaning device 1 according to an embodiment of the invention. The particular wet cleaning device 1 represented in FIG. 1 and described in the following is just one example of many types of cleaning devices which are feasible in the framework of the invention. In this respect, it is noted that the invention does not only relate to wet cleaning devices, but also to other types of cleaning devices such as wet/dry cleaning devices having a dry cleaning function besides a wet cleaning function, and vacuum cleaners having a vacuum cleaning function besides a wet cleaning function and possibly also a dry cleaning function.

The wet cleaning device 1 is configured to be used for the purpose of subjecting a surface 2 such as a floor surface to a wet cleaning action. At a side that is supposed to face the surface 2 during operation of the wet cleaning device 1, the wet cleaning device 1 comprises a cleaning system 10 including a cleaning element 11. In the following, it is assumed that the cleaning element 11 comprises a roller-shaped brush that is rotatable about its longitudinal axis, which does not alter the fact that other embodiments of the cleaning element 11 are possible as well. In the framework of the invention, the cleaning system 10 may comprise more than one cleaning element. For example, the cleaning system 10 may comprise a pair of roller-shaped brushes which are arranged so as to be rotatable in opposite directions about their respective longitudinal axes.

The wet cleaning device 1 comprises a first reservoir 12 that serves for containing a cleaning liquid, and a wetting system 20 that serves for supplying the cleaning liquid to the brush 11 during operation of the wet cleaning device 1, and that is positioned between the first reservoir 12 and the cleaning system 10 to that end. The wetting system 20 may comprise any suitable type of pump arrangement 21, for example. The wet cleaning device 1 also comprises a second reservoir 13 that serves for containing used, dirty cleaning liquid, and a discharging system 30 that serves for receiving a mixture of cleaning liquid and dirt from the brush 11 and for transporting the mixture to the second reservoir 13, and that is positioned between the cleaning system 10 and the second reservoir 13 to that end. Although this is not illustrated in FIG. 1, all of the cleaning system 10, the reservoirs 12, 13, the wetting system 20 and the discharging system 30 may be accommodated in a suitable housing of the wet cleaning device 1. The wet cleaning device 1 comprises a handle 40 that is configured to be held by a user of the wet cleaning device 1, so that the user can easily grasp the wet cleaning device 1 and move it across the surface 2 to be cleaned as desired. Preferably, the wet cleaning device 1 is a cordless device comprising a rechargeable battery arrangement 41, as shown, wherein it is practical if the wet cleaning device 1 is part of a set including a charging dock 3 besides the wet cleaning device 1. Such a set may also include a flushing tray that can be used for the purpose of cleaning the brush 11.

Basic aspects of how the wet cleaning device 1 is operated are as follows. During operation, the brush 11 is driven so as to rotate and the wetting system 20 is activated so as to supply the cleaning liquid to the brush 11, as indicated in FIG. 1 by a downward arrow on the left, and to thereby cause the brush 11 to be in a wet cleaning condition. An area of the surface 2 that is within reach of the brush 11 is wetted by the brush 11. Any stains as may be present on the area of the surface 2 are detached under the influence of the cleaning liquid and/or are scrubbed off by the brush 11, and any dirt as may be present on the area of the surface 2 is removed along with the cleaning liquid that is sucked towards the second reservoir 13 by means of the discharging system 30, as indicated in FIG. 1 by an upward arrow on the right. The brush 11 may particularly include flexible brush elements having tip portions for contacting the surface 2.

The wet cleaning device 1 is equipped with a user interface 42 including an on/off button. Assuming an off mode of the wet cleaning device 1, operation of the wet cleaning device 1 is initiated when the user depresses the on/off button. The wet cleaning device 1 comprises a controlling system 50 including a microcontroller that is programmed to put the brush 11 in motion and to activate both the wetting system 20 and the discharging system 30 in reaction to the user depressing the on/off button. When the user depresses the on/off button once again, the user causes the controlling system 50 to control the wet cleaning device 1 to stop operating through shutting down power supply to the various functional components of the wet cleaning device 1.

The wet cleaning device 1 comprises a timer 43 that is configured to be activated to count when a predetermined event takes place in respect of the wet cleaning device 1, such as termination of operation of the wetting system 20, which coincides with termination of operation of the entirety of the wet cleaning device 1 in the present embodiment. The controlling system 50 is programmed to check the actual time value that is present in the timer 43 when the wet cleaning device 1 is put from the off mode to the on mode, and to compare the actual time value to a threshold time value. If the actual time value appears to be higher than the threshold time value, the controlling system 50 controls the wetting system 20 to operate in a special mode during a predetermined period of time, namely a boost operation mode which involves increased pumping speed and associated faster supply of the cleaning fluid to the brush 11. This procedure is based on the insight that after a certain time of non-use of the wet cleaning device 1, the brush 11 dries, and that when the wet cleaning device 1 is put to the on mode without the brush 11 being in the wet cleaning condition, it would take quite some time for the wet cleaning device 1 to be able to effectively perform a wet cleaning action as desired if it was not for the temporary special operation mode of the wetting system 20. Thus, the timer 43 serves to provide the indication that is needed by the controlling system 50 for determining whether to control the wetting system 20 to operate in the normal operation mode or to control the wetting system 20 to operate in the boost operation mode during start-up of the wet cleaning device 1. When it appears that the actual time value that is retrieved from the timer 43 is lower than the threshold time value, the wetting system 20 is controlled to operate in the normal operation mode right from the start, based on the assumption that the brush 11 is still wet enough, i.e. is in the wet cleaning condition.

Additionally or alternatively, the controlling system 50 may be programmed to take one or more other factors into account for the purpose of determining which operation mode of the wetting system 20 should be set during start-up of the wet cleaning device 1. Examples of such other factors include an indication whether or not the wet cleaning device 1 was on the charging dock 3 before the wet cleaning device 1 was put to the on mode, an indication whether the brush 11 was replaced/mounted in the cleaning system 10 before the wet cleaning device 1 was put to the on mode, and an indication whether the battery arrangement 41 was replaced or recharged after having run out completely. In respect of the latter example, it is noted that interruption of power supply from the battery arrangement 41 may result in complete flush of a memory of the controller arrangement 50 so that the indication may be obtained by assessing the state of the memory.

During operation of the wet cleaning device 1, it may be desirable to control the wetting system 20 to be in the boost operation mode, for example in the case of a stain that is difficult to remove. In view thereof, the user interface 42 may further be equipped with a button for triggering the boost operation mode of the wetting system 20. In such a case, the controlling system 50 may be programmed to control the wetting system 20 to operate in the boost operation mode during a predetermined period of time when the user depresses the button as mentioned.

If the boost operation mode is initiated automatically and the user acts to prematurely terminate the boost operation mode, one of several options may be applicable, depending on the way in which the controlling system 50 is programmed. In the first place, the controlling system 50 may be programmed to subsequently control operation of the wet cleaning device 1 in the same way as when the boost operation mode would have been performed during a complete period of time. In the second place, the controlling system 50 may be programmed to control operation of the wet cleaning device 1 in the same way as when the boost operation mode would not have been initiated. In the third place, the controlling system 50 may be programmed to continue the boost operation mode until the complete period of time of the boost operation mode has lapsed.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

It follows from the foregoing that it is not essential to the invention that the cleaning device 1 is equipped with a rechargeable battery arrangement 41. In this respect, it is noted that the invention also covers the use of a simple dock for receiving and holding the cleaning device, which is without charging ability. Hence, the invention also relates to a set of a cleaning device 1 and a dock, wherein the dock is configured to receive and hold the cleaning device 1.

The invention may be summarized as follows. A cleaning device 1 for cleaning a surface 2 is operable in at least a wet operation mode and comprises at least one cleaning element 11 and a wetting system 20 configured to supply a cleaning liquid to an area where the at least one cleaning element 11 is located, wherein the wetting system 20 is operable in one of at least one normal operation mode and a boost operation mode involving an increased supply rate of the cleaning liquid with respect to the at least one normal operation mode. During start-up of the cleaning device 1 in the wet cleaning mode thereof, a start-up operation mode of the wetting system 20 is determined to be one of the at least one normal operation mode or the boost operation mode on the basis of assessment of an actual value of at least one parameter that is indicative of whether or not the at least one cleaning element 11 is in a wet cleaning condition.

The invention claimed is:

1. A cleaning device for cleaning a surface, the cleaning device being operable in at least a wet operation mode and comprising:

at least one cleaning element configured to perform a cleaning action on the surface to be cleaned, a wetting system configured to supply a cleaning liquid to an area where the at least one cleaning element is located to thereby realize a wet cleaning condition of the at least one cleaning element in the wet operation mode of the cleaning device, wherein the wetting system is operable in one of at least one normal operation mode and a boost operation mode involving an increased supply rate of the cleaning liquid with respect to the at least one normal operation mode, and a controlling system configured to control operation of the cleaning device according to an operation program, wherein the operation program includes a wet operation mode algorithm involving a sequence of start-up steps to be taken when the wet operation mode of the cleaning device is initiated, and wherein the start-up steps comprise;

retrieving an actual value of at least one parameter that is indicative of whether or not the at least one cleaning element is in the wet cleaning condition, determining a start-up operation mode of the wetting system to be one of the at least one normal operation mode or the boost operation mode by relating the actual value of the at least one parameter to an operation mode of the wetting system according to a predetermined relation between values of the at least one parameter and respective operation modes of the wetting system, and controlling the wetting system to operate in the start-up operation mode.

2. The cleaning device of claim 1, comprising a sensor arrangement to measure wetness of the at least one cleaning element directly or indirectly.

3. The cleaning device of claim 1, wherein the wetting system includes a pump arrangement configured to supply the cleaning liquid to the area where the at least one cleaning element is located by pumping the cleaning liquid towards the area where the at least one cleaning element is located, and wherein the boost operation mode of the wetting system involves operating the pump arrangement to run at a higher pumping speed than in the at least one normal operation mode of the wetting system.

4. The cleaning device claim 1, wherein the start-up steps comprise controlling the wetting system to stop operating in the start-up operation mode after a predetermined period of time in case the start-up operation mode of the wetting system is the boost operation mode.

5. The cleaning device of claim 1, comprising a timer configured to be activated to count when a predetermined event takes place in respect of the cleaning device, wherein retrieving the actual value of at least one parameter that is indicative of whether or not the at least one cleaning element is in the wet cleaning condition comprises retrieving an actual time value from the timer.

6. The cleaning device of claim 5, wherein the predetermined event is termination of operation of the wetting system.

7. The cleaning device of claim 1, wherein the at least one cleaning element is removable from the cleaning device, and wherein retrieving the actual value of at least one parameter that is indicative of whether or not the at least one cleaning element is in the wet cleaning condition comprises retrieving an indication of whether or not an action of putting the at least one cleaning element to place in the cleaning device has taken place prior to an initiation of the wet operation mode of the cleaning device.

8. The cleaning device of claim 1, comprising a user interface configured to at least communicate a user's command to operate the wetting system in the boost operation mode to the controlling system, wherein the controlling system is configured to control the wetting system to operate in the boost operation mode during a predetermined period of time upon receipt of the command from the user interface.

9. The cleaning device of claim 8, wherein the cleaning device is also operable in a dry operation mode, wherein the user interface is configured to also communicate a user's command to operate the cleaning system in the dry operation mode to the controlling system, and wherein the operation program includes a dry operation mode algorithm according to which the wetting system is inactivated.

10. The cleaning device of claim 1, wherein the at least one cleaning element comprises a brush, and wherein the brush includes flexible brush elements having tip portions for contacting the surface to be cleaned.

11. The cleaning device of claim 1, wherein the at least one cleaning element is movable in the cleaning device.

12. The cleaning device of claim 1, comprising a reservoir configured to contain the cleaning liquid to be supplied to the area where the at least one cleaning element is located by means of the wetting system.

13. The cleaning device of claim 1, comprising a discharging system configured to receive a liquid and dirt mixture from the at least one cleaning element and to discharge the liquid and dirt mixture to a collection area.

14. The cleaning device of claim 1, comprising a vacuum system including a vacuum source configured to generate underpressure at a position of the at least one cleaning element.

15. A cleaning device of claim 1 and a charging dock, wherein the cleaning device comprises a rechargeable battery arrangement, and wherein the charging dock is configured to receive and hold the cleaning device and to charge the rechargeable battery arrangement of the cleaning device when the cleaning device is in place on the charging dock.

* * * * *